US012655550B2

(12) United States Patent
Wei et al.

(10) Patent No.: US 12,655,550 B2
(45) Date of Patent: Jun. 16, 2026

(54) MULTI-NESTED TWISTING LOOM, METHOD, FABRIC WEAVE, AND UPPER

(71) Applicant: ZHEJIANG JULIBAO TEXTILE TECHNOLOGY CO., LTD, Huzhou (CN)

(72) Inventors: Bin Wei, Huzhou (CN); Yadong Mao, Huzhou (CN); Jiaming Xu, Huzhou (CN)

(73) Assignee: ZHEJIANG JULIBAO TEXTILE TECHNOLOGY CO., LTD, Huzhou (CN)

( * ) Notice: Subject to any disclaimer, the term of this patent is extended or adjusted under 35 U.S.C. 154(b) by 0 days.

(21) Appl. No.: 18/723,647

(22) PCT Filed: Dec. 5, 2023

(86) PCT No.: PCT/CN2023/136288
§ 371 (c)(1),
(2) Date: Nov. 17, 2025

(87) PCT Pub. No.: WO2025/112081
PCT Pub. Date: Jun. 5, 2025

(65) Prior Publication Data

US 2026/0071358 A1 Mar. 12, 2026

(30) Foreign Application Priority Data

Nov. 29, 2023 (CN) ..... 202311613600.0

(51) Int. Cl.
*D03C 7/00* (2006.01)
*D03D 1/00* (2006.01)
(Continued)

(52) U.S. Cl.
CPC ..... *D03D 13/006* (2013.01); *D03D 1/00* (2013.01); *D03D 19/00* (2013.01); *D10B 2501/043* (2013.01)

(58) Field of Classification Search
CPC ..... D03D 13/006; D03D 1/00; D03D 19/00; D03D 9/00; D10B 2501/043; D03C 7/005;
(Continued)

(56) References Cited

U.S. PATENT DOCUMENTS 4,572,241 A * 2/1986 Kramer ..... D03C 7/02 139/52
9,609,916 B2 * 4/2017 Song ..... D03C 7/00
(Continued)

FOREIGN PATENT DOCUMENTS

CN 101285232 A 10/2008
CN 107075753 A 10/2016
CN 106868683 A 6/2017

OTHER PUBLICATIONS

Office Action for Chinese Patent Application No. 2023116136000 dated Sep. 12, 2024.
(Continued)

*Primary Examiner* — Robert H Muromoto, Jr.
(74) *Attorney, Agent, or Firm* — Olive Law Group, PLLC

(57) ABSTRACT

Disclosed is a multi-nested twisting loom, a method, a fabric weave, and an upper. The multi-nested twisting loom includes several nested twisting heald sets. The nested twisting heald sets are sequentially arranged along a weft direction on the loom. Each nested twisting heald set includes a second-level twisting heald at a front end of a warp advancing direction and a first-level twisting heald at a rear end. The second-level twisting heald is composed of a single twisting heald. The first-level twisting heald is composed of m twisting healds, where m is greater than 1.
(Continued)

The leno weave in the present disclosure is composed of different levels of twisted areas, which increases the variety of leno weaves. Breathable holes with different sizes are formed between different levels of twisted areas, which better fit various parts of the human body and meet the different breathable needs of different parts.

19 Claims, 7 Drawing Sheets

(51) Int. Cl.
*D03D 13/00* (2006.01)
*D03D 19/00* (2006.01)

(58) Field of Classification Search
CPC .... D03C 7/02; D03C 7/00; A43B 1/04; A43B 23/0205
See application file for complete search history.

(56) References Cited

U.S. PATENT DOCUMENTS

| | | | | |
|---|---|---|---|---|
| 9,756,901 | B2 * | 9/2017 | Musho | A43B 23/0265 |
| 2013/0333794 | A1 * | 12/2013 | Hockemeyer | D03C 7/06 139/50 |
| 2017/0118926 | A1 * | 5/2017 | Toye | A01G 13/21 |
| 2024/0200240 | A1 * | 6/2024 | Song | A43B 1/05 |
| 2024/0225196 | A1 * | 7/2024 | Song | A43B 1/04 |

OTHER PUBLICATIONS

Response to Office Action dated Sep. 12, 2024 for Chinese Patent Application No. 2023116136000.
Notice of Allowance dated Oct. 10, 2024 for Chinese Patent Application No. 2023116136000.
Allowable Claims for Chinese Patent Application No. 2023116136000.

* cited by examiner

MULTI-NESTED TWISTING LOOM, METHOD, FABRIC WEAVE, AND UPPER

TECHNICAL FIELD

This is a 371 national stage application of PCT International Patent Application No. PCT/CN2023/136288, filed on Dec. 5, 2023, which claims priority to Chinese Patent Application No. 2023116136000 filed on Nov. 29, 2023; the disclosures of which are incorporated herein by reference in their entireties.

CROSS REFERENCE TO RELATED APPLICATIONS

The present disclosure relates the technical field of weaving, and in particular to a multi-nested twisting loom, a method, a fabric weave, and an upper.

BACKGROUND

The loom, as a device for weaving fabrics by crossing warps and wefts, is a device that weaves fabrics by passing wefts through openings between the warps when a portion of the warps are lifted after the wefts are passed through.

The weaves of fabrics woven by different types of looms include a leno weave and a jacquard weave. Leno weave refers to the fabric weave formed with twisting of warps formed by two system warps, i.e., ground warps and twisting warps, and one system weft. Eyelets formed by the twisting of warps on the leno fabric are called yarn twisting holes. Jacquard weave refers to a pattern formed by the staggered changes of warps or wefts that are floated or interwoven on the surface of a fabric according to regular requirements.

In the past, looms were able to combine the leno weave and the jacquard weave to create a new fabric weave. The leno weave in this type of fabric weave was often in a single configuration, and several breathable holes formed on the leno weave had the same size, for example, as described in Korean patent application No. 201580060919.2, titled "LOOM FOR WEAVING FABRIC INCLUDING HETEROGENEOUS WEAVES, UPPERS WOVEN USING THE SAME, AND SHOES", and in Chinese patent application No. 201710228075.9, titled "FABRIC WITH HOLES WOVEN BY JACQUARD AND WEAVING METHOD THEREOF".

As described above, previous looms only used a single level of twisting healds and jacquard healds to achieve the weaving of fabric weaves, which neither were able to combine higher levels of twisting healds and jacquard healds to achieve the weaving of new fabric weaves, nor were able to combine different levels of twisting healds and jacquard healds to produce fabric weaves containing different types of leno weaves, which further causes the singularity of the fabric formed by the fabric weaves.

However, when using the multi-nested twisting loom and weaving method provided by the present disclosure, even when the fabric weave contains different leno weaves, they can be combined with the jacquard weave, thus not only forming breathable holes with different sizes to improve the breathability of the fabric, but also no longer limiting the configuration of the fabric weave on the fabric, so that it can be applied to various fabrics such as vamps, and can be made into clothing such as uppers.

SUMMARY

In order to overcome the above defects in the related art, the present disclosure provides a multi-nested twisting loom, a method, a fabric weave, and a vamp.

In order to achieve the above purpose, the present disclosure adopts the following technical solution: a multi-nested twisting loom, including:

several nested twisting heald sets, the nested twisting heald sets being sequentially arranged along a weft direction on the loom, each nested twisting heald set including a second-level twisting heald at a front end of a warp advancing direction and a first-level twisting heald at a rear end, the second-level twisting heald being composed of a single twisting heald, the first-level twisting heald being composed of m twisting healds, where m is an integer greater than 1, the second-level twisting heald being configured to form a leno weave twisted by a plurality of ground warps, the first-level twisting heald being configured to form a leno weave containing m twisted sets through the plurality of ground warps from the second-level twisting heald.

As an exemplary solution of the present disclosure, the multi-nested twisting loom includes a jacquard heald, and the jacquard heald is arranged at a rear end of the nested twisting heald sets.

As an exemplary solution of the present disclosure, the m twisting healds of the first-level twisting heald are arranged abreast along the weft direction.

As an exemplary solution of the present disclosure, the m twisting healds of the first-level twisting heald are arranged in a staggered manner along a diagonal direction.

As an exemplary solution of the present disclosure, each nested twisting heald set further includes a sublevel twisting heald of the first-level twisting heald arranged at a rear end of the first-level twisting heald, the sublevel twisting heald of the first twisting heald is composed of x twisting healds, where x is an integer greater than 1, and the sublevel twisting heald of the first twisting heald is configured to form a leno weave containing x twisted sets through a plurality of ground warps from at least one twisting heald of the m twisting healds of the first-level twisting heald.

As an exemplary solution of the present disclosure, the jacquard heald weaves to form a jacquard weave of a vamp, the nested twisting heald sets weave to form a leno weave with breathable holes of the vamp, and the vamp forms a configuration of an upper.

A multi-nested twisting method, the number of twisting healds of a first-level twisting heald being m, where m is an integer greater than 1, a second-level twisting heald being composed of a single twisting heald, the multi-nested twisting method including the following steps:

S1: forming a twisting warp by passing at least one warp of warps through a twisting heald hole of a twisting heald of the second-level twisting heald, the twisting warp no longer passing through other twisting healds of a current nested twisting heald set; forming a first set of ground warps by passing other warps through an internal space of the twisting heald of the second-level twisting heald;

S2: forming a new set of warps at a front end of the first-level twisting heald through the first set of ground warps, dividing the new set of warps into m sets, and forming a twisting warp by passing at least one warp through a twisting heald hole of each twisting heald of the first-level twisting heald, the twisting warp no longer passing through other twisting healds of the first-level twisting heald; forming a ground warp by passing at least one warp through an internal space of each twisting heald of the first-level twisting heald, the ground warp no longer passing through internal spaces of other twisting healds of the first-level twisting heald;

S3: forming warps arranged along the same direction as in S1 by passing any twisting warp and ground warp in S1 and S2 through the second-level twisting heald and the first-level twisting heald; and S4: weaving wefts with warps according to requirements of a fabric weave.

As an exemplary solution of the present disclosure, the twisting warp in step S1 passes from a left side or right side outside the other twisting healds of the current nested twisting heald set.

As an exemplary solution of the present disclosure, the twisting warp in step S2 passes from a left side or right side outside the other twisting healds of the first-level twisting heald.

A multi-nested twisted fabric weave, including a leno weave, the leno weave including primary twisted areas and secondary twisted areas formed by weaving the same batch of warps along a warp direction in one step, all ground warps twisted by twisting warps of the secondary twisted areas being divided into m sets, each primary twisted area being formed by using at least one of the ground warps of each set as a twisting warp and using at least one as a ground warp to form corresponding m independent primary twisted areas;

the leno weave including breathable holes, the breathable holes including large holes and small holes, relatively the large holes being formed between adjacent secondary twisted areas, the small holes being formed between adjacent primary twisted areas.

As an exemplary solution of the present disclosure, the twisting warps of the secondary twisted areas in the range of the warp direction of the same batch of warps do not participate in the twisting of the primary twisted areas.

As an exemplary solution of the present disclosure, at least one twisting warp of the secondary twisted areas in the range of the warp direction of the same batch of warps participates in the twisting of the primary twisted areas.

As an exemplary solution of the present disclosure, the fabric weave includes any one or any combination of three elementary weaves and derivative weaves thereof.

As an exemplary solution of the present disclosure, any one or any combination of three elementary weaves and derivative weaves thereof is formed between the primary twisted areas and the secondary twisted areas along the warp direction.

As an exemplary solution of the present disclosure, the fabric weave forms a vamp, the leno weave forms a breathable part of the vamp, and any one or any combination of three elementary weaves and derivative weaves thereof maintains a configuration of the vamp.

An upper, including:

a first fabric forming a vamp configured to maintain a configuration; and a second fabric with a different weave structure from the first fabric, the first fabric being in any one or any combination of three elementary weaves and derivative weaves thereof, the second fabric being in a leno weave.

A multi-nested twisted fabric weave, including a leno weave, the leno weave including primary twisted areas and secondary twisted areas formed by weaving the same batch of warps in one step, all ground warps twisted by twisting warps of the secondary twisted areas being divided into m sets, each primary twisted area being formed by using at least one of the ground warps of each set as a twisting warp and using at least one as a ground warp to form corresponding m independent primary twisted areas;

the twisting warps of the secondary twisted areas participating in the twisting of at least one of the primary twisted areas to form a multi-twisted area.

As an exemplary solution of the present disclosure, the fabric weave includes any one or any combination of three elementary weaves and derivative weaves thereof.

As an exemplary solution of the present disclosure, any one or any combination of three elementary weaves and derivative weaves thereof is formed between the primary twisted areas and the secondary twisted areas along the warp direction.

As an exemplary solution of the present disclosure, the fabric weave forms a vamp, the leno weave forms a breathable part of the vamp, and any one or any combination of three elementary weaves and derivative weaves thereof maintains a configuration of the vamp.

An upper, including:

a first fabric forming a vamp configured to maintain a configuration; and a second fabric with a different weave structure from the first fabric, the first fabric being in any one or any combination of three elementary weaves and derivative weaves thereof, the second fabric being in a leno weave.

In order to achieve the above purpose, the present disclosure further provides a multi-nested twisting loom, including:

several nested twisting heald sets, the nested twisting heald sets being sequentially arranged along a weft direction on the loom, each nested twisting heald set including a second-level twisting heald at a front end of a warp advancing direction and a first-level twisting heald at a rear end;

the second-level twisting heald being composed of a single twisting heald, a warp passing through a twisting heald hole of a twisting heald of the second-level twisting heald to form a twisting warp and no longer passing through other twisting healds of a current nested twisting heald set, a warp passing through an internal space of the twisting heald of the second-level twisting heald to form a ground warp;

the first-level twisting heald being composed of m twisting healds, where m is an integer greater than 1, ground warps passing through the second-level twisting heald forming warps at a front end of the first-level twisting heald, the warps being divided into m sets, at least one warp passing through a twisting heald hole of each set of twisting healds as a twisting warp, at least one warp passing through an internal space of each set of twisting healds as a ground warp, each set of twisting warps no longer passing through other twisting healds of the first-level twisting heald, each set of ground warps no longer passing through other twisting healds of the first-level twisting heald.

As an exemplary solution of the present disclosure, the multi-nested twisting loom includes a jacquard heald, the jacquard heald is arranged at a rear end of the nested twisting heald sets, and the ground warp passing through the nested twisting heald sets as the warp passes through the jacquard heald.

As an exemplary solution of the present disclosure, the m twisting healds of the first-level twisting heald are arranged abreast along the weft direction.

As an exemplary solution of the present disclosure, the m twisting healds of the first-level twisting heald are arranged in a staggered manner along a diagonal direction.

As an exemplary solution of the present disclosure, the jacquard heald weaves to form a jacquard weave of a vamp, the nested twisting heald sets weave to form a leno weave with breathable holes of the vamp, and the vamp forms a configuration of an upper.

A multi-nested twisting method, the number of twisting healds of a first-level twisting heald being m, where m is an integer greater than 1, the multi-nested twisting method including the following steps:

S1: forming a twisting warp by passing at least one warp of warps through a twisting heald hole of a twisting heald of the second-level twisting heald, the twisting warp no longer passing through other twisting healds of a current nested twisting heald set; forming a first set of ground warps by passing other warps through an internal space of the twisting heald of the second-level twisting heald;

S2: forming a new set of warps at a front end of the first-level twisting heald through the first set of ground warps, dividing the new set of warps into m sets, and forming a twisting warp by passing at least one warp through a twisting heald hole of each twisting heald of the first-level twisting heald, the twisting warp no longer passing through other twisting healds of the first-level twisting heald; forming a ground warp by passing at least one warp through an internal space of each twisting heald of the first-level twisting heald, the ground warp no longer passing through internal spaces of other twisting healds of the first-level twisting heald;

S3: forming warps arranged along the same direction as in S1 by passing any twisting warp and ground warp in S1 and S2 through the second-level twisting heald and the first-level twisting heald; and

S4: weaving wefts with warps according to requirements of a fabric weave.

As an exemplary solution of the present disclosure, the twisting warp in step S1 passes from a left side or right side outside the other twisting healds of the current nested twisting heald set.

As an exemplary solution of the present disclosure, the twisting warp in step S2 passes from a left side or right side outside the other twisting healds of the first-level twisting heald.

A multi-nested twisted fabric weave, including a leno weave, the leno weave including primary twisted areas and secondary twisted areas formed by weaving the same batch of warps along a warp direction in one step, twisting warps in the secondary twisted areas not participating in the twisting of the primary twisted areas, all ground warps twisted by the twisting warps of the secondary twisted areas being divided into m sets, each primary twisted area being formed by using at least one of the ground warps of each set as a twisting warp and using at least one as a ground warp to form corresponding m independent primary twisted areas;

the leno weave including breathable holes, the breathable holes including large holes and small holes, relatively the large holes being formed between adjacent secondary twisted areas, the small holes being formed between adjacent primary twisted areas.

As an exemplary solution of the present disclosure, the fabric weave includes any one or any combination of three elementary weaves and derivative weaves thereof.

As an exemplary solution of the present disclosure, any one or any combination of three elementary weaves and derivative weaves thereof is formed between the primary twisted areas and the secondary twisted areas along the warp direction.

As an exemplary solution of the present disclosure, the fabric weave forms a vamp, the leno weave forms a breathable part of the vamp, and any one or any combination of three elementary weaves and derivative weaves thereof maintains a configuration of the vamp.

An upper, including a first fabric forming a vamp configured to maintain a configuration; and a second fabric with a different weave structure from the first fabric, the first fabric being in any one or any combination of three elementary weaves and derivative weaves thereof, the second fabric being in a leno weave.

The above technical features may be combined with each other as long as they do not conflict with each other.

The Present Disclosure has the Following Beneficial Effects:

1. Compared with the related art, in the present disclosure, since a plurality of levels of twisting healds are arranged in the current nested twisting heald set and a plurality of twisting healds are arranged in each level of twisting healds, a plurality of levels of twisted areas with large area can be formed. Since numerous warps and wefts are woven complicatedly in the plurality of levels of twisted areas, the strength is better and the compression performance is better. Correspondingly, the breathable holes between the plurality of levels of twisted areas become larger, thus greatly improving the breathability of the leno weave.
2. Compared with the related art, in the present disclosure, since the leno weave is composed of different levels of twisted areas, the pattern complexity of the leno weave is increased. Moreover, since breathable holes with different sizes are formed between different levels of twisted areas, the breathable holes with different sizes can be more fit with each part of the human body, thus meeting different breathability requirements of different parts.
3. In the present disclosure, since the twisting warp passes from the left side or right side outside the other twisting healds of the current nested twisting heald set, a configuration that the twisting warp is located on the outermost or innermost side of the secondary twisted areas can be formed, layer-by-layer dense weaving can be achieved in the secondary twisted areas, the strength of the twisting warp is greatly improved, and it facilitates maintaining the configuration of the secondary twisted areas under the external action.
4. In the present disclosure, when the arrangement space allows, the m twisting healds of the first-level twisting heald are arranged abreast along the weft direction. Since the twisting healds themselves have a certain volume, when it is required to reduce the influence of the volume of the twisting healds, the m twisting healds are arranged in a staggered manner. More specifically, the front and rear twisting healds are not located on the same straight line, but have a position relationship of staggered arrangement along the diagonal direction. Based on the position relationship, the m twisting healds of the first-level twisting heald can be simultaneously weave the warps at the front end of the first-level twisting heald, thus improving the weaving efficiency.

5. In the present disclosure, since the first-level twisting heald and second-level twisting heald are arranged in the loom, and the number of the twisting healds of the first-level twisting heald is variable, different types of fabric weaves can be woven. Compared with the related art which can only weave the same type of fabric weaves, the applicable range is wider, thus meeting different needs of fabric weaving.
6. In the present disclosure, through the multi-nesting principle, a next-level twisting heald can be arranged at the rear end of the first-level twisting heald to achieve multi-nesting, thus providing a larger design space for pattern design, forming different product gradients and meeting the needs of different customers.
7. In the present disclosure, the twisting warps in the twisted areas of a previous level can be twisted with the twisted areas of a next level to form different types of fabric weaves, thus enriching the diversity of the fabric weaves.

DESCRIPTION OF REFERENCE NUMERALS

1—first twisting warp, 2—second twisting warp, 3—third twisting warp, 100—nested twisting heald set, 101—first-level twisting heald, 102—second-level twisting heald, 200—primary twisted area, 300—secondary twisted area, 400—multi-twisted area.

DETAILED DESCRIPTION

In order to make the purpose, technical solution, and advantages of the present disclosure clearer, the present disclosure will be further described below in detail in combination with the drawings and the examples. It is to be understood that the specific examples described here are only intended to explain the present disclosure and are not intended to limit the present disclosure. In addition, the technical features involved in the various implementations of the present disclosure described below may be combined with each other as long as they do not conflict with each other. The present disclosure will be further described below in detail in combination with the specific implementations.

Figure 1:
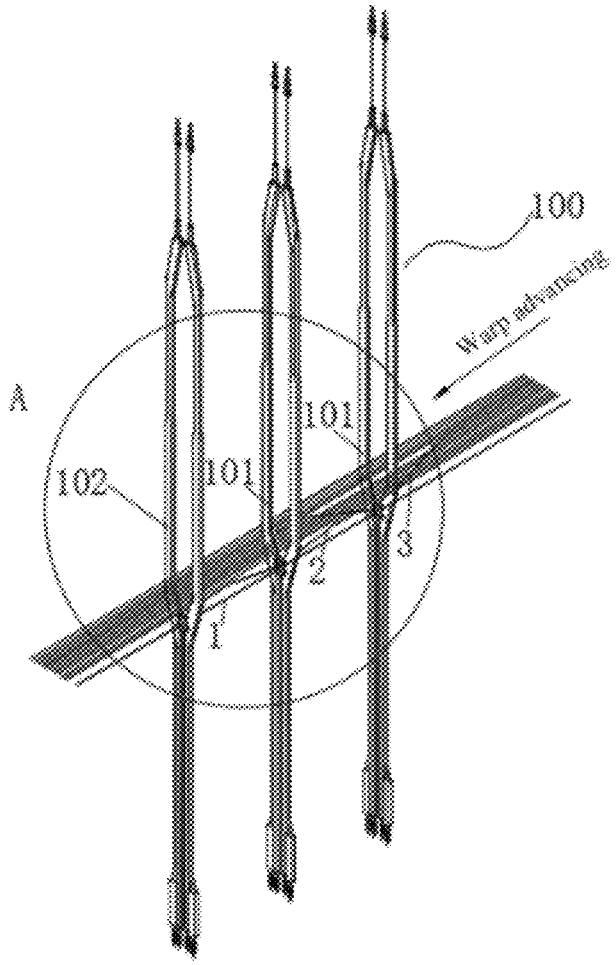
FIG. 1 illustrates a schematic structural diagram of a loom according to the present disclosure.

For the warp advancing direction in the loom, refer to FIG. 1.

Figure 2:
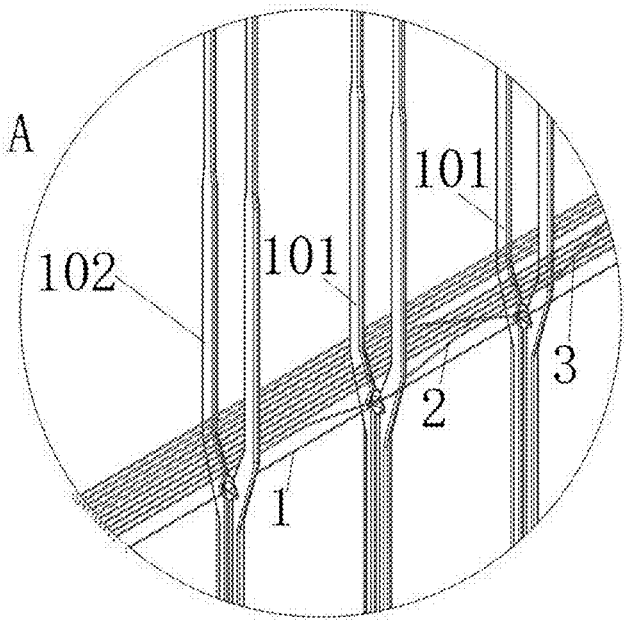
FIG. 2 illustrates a partial enlarged diagram of position A according to the present disclosure.
Figure 3:
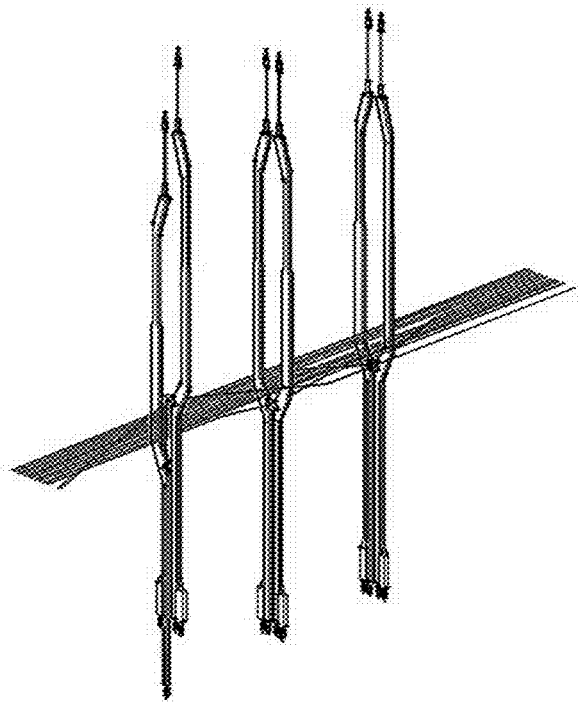
FIG. 3 illustrates a schematic diagram I of action of a loom according to the present disclosure.
Figure 4:
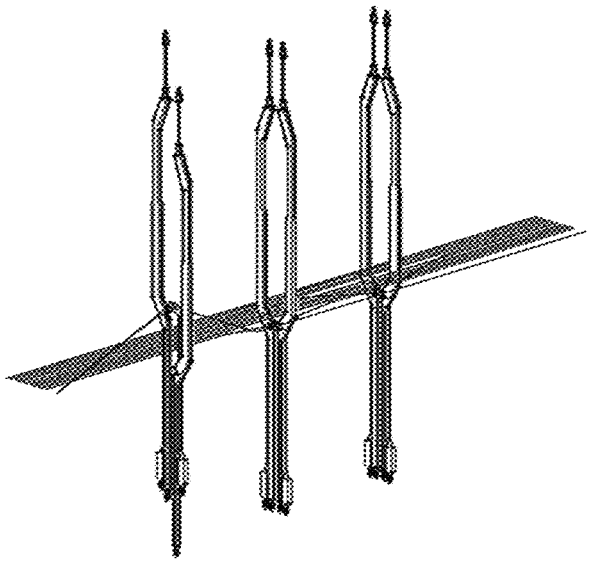
FIG. 4 illustrates a schematic diagram II of action of a loom according to the present disclosure.
Figure 5:
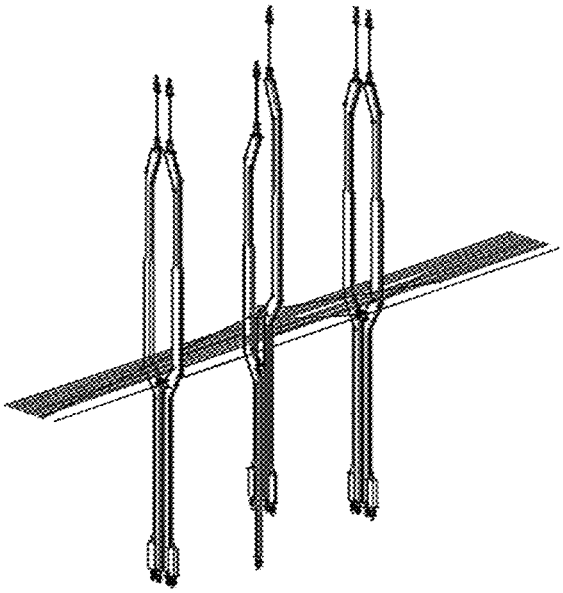
FIG. 5 illustrates a schematic diagram III of action of a loom according to the present disclosure.
Figure 6:
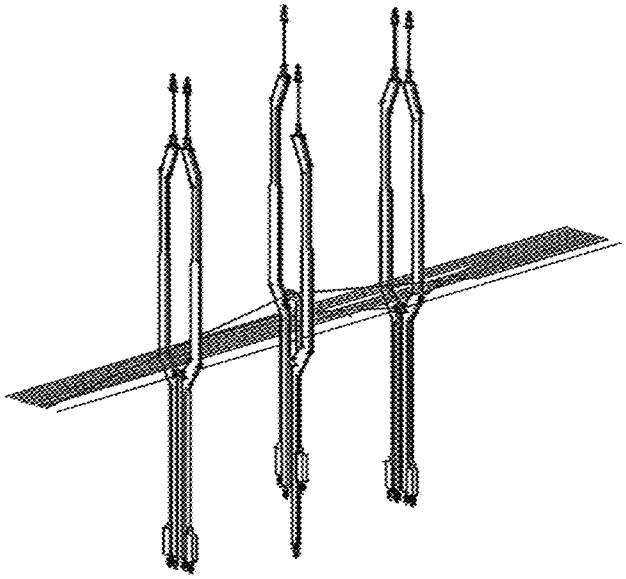
FIG. 6 illustrates a schematic diagram IV of action of a loom according to the present disclosure.
Figure 7:
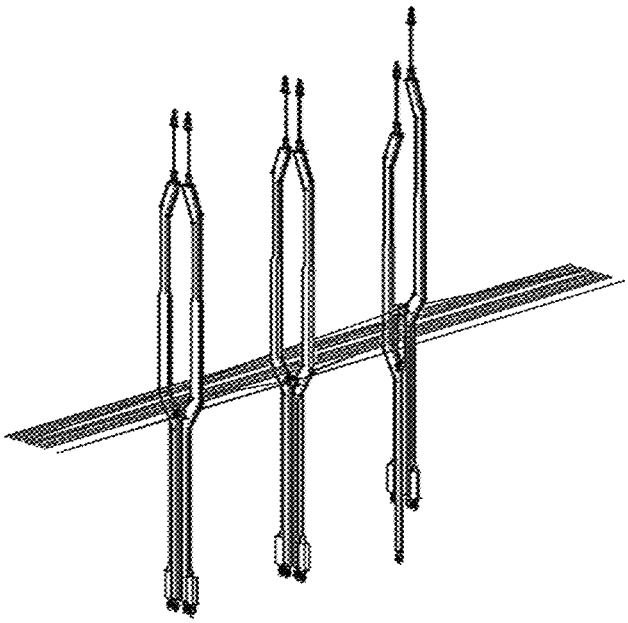
FIG. 7 illustrates a schematic diagram V of action of a loom according to the present disclosure.
Figure 8:
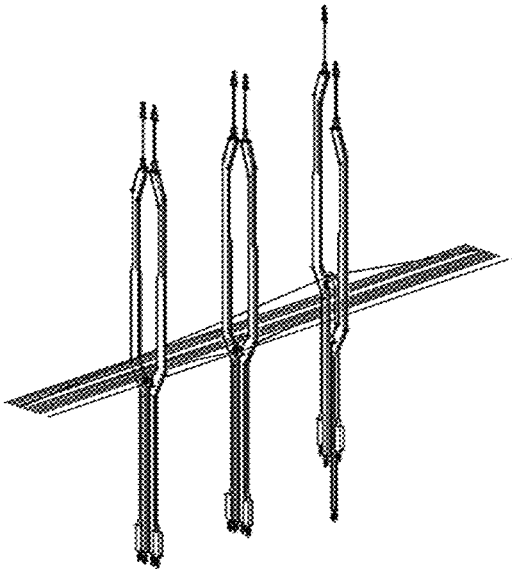
FIG. 8 illustrates a schematic diagram VI of action of a loom according to the present disclosure.
Figure 9:
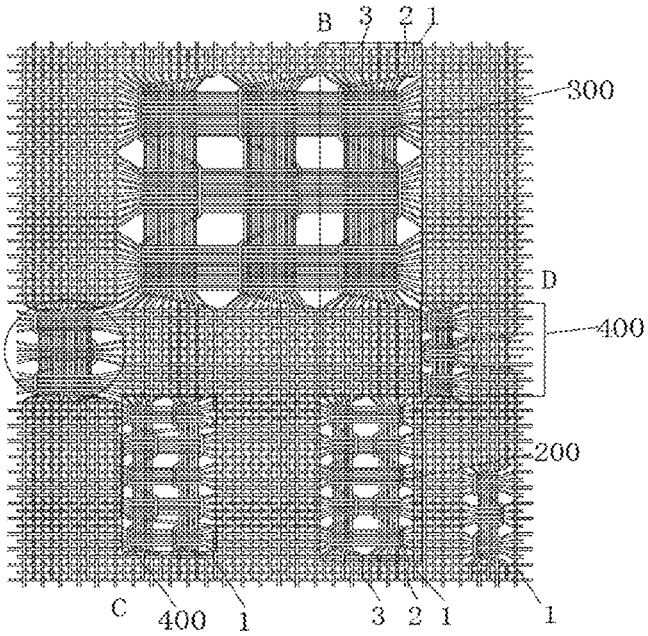
FIG. 9 illustrates a schematic structural diagram of a fabric weave according to the present disclosure.

Referring to FIG. 1 and FIG. 2, a multi-nested twisting loom includes several nested twisting heald sets 100. The nested twisting heald sets 100 are sequentially arranged along a weft direction on the loom. Each nested twisting heald set 100 includes a second-level twisting heald 102 at a front end of a warp advancing direction and a first-level twisting heald 101 at a rear end.

The second-level twisting heald 102 is composed of a single twisting heald. The first-level twisting heald 101 is composed of m twisting healds, where m is an integer greater than 1.

The second-level twisting heald 102 is configured to form a leno weave twisted by a plurality of ground warps. The first-level twisting heald 101 is configured to form a leno weave containing m twisted sets through the plurality of ground warps from the second-level twisting heald 102.

From FIG. 1 and FIG. 2, it can be understood that a warp passes through a twisting heald hole of a twisting heald of the second-level twisting heald 102 to form a twisting warp and no longer passes through other twisting healds of a current nested twisting heald set 100, and a warp passes through an internal space of the twisting heald of the second-level twisting heald 102 to form a ground warp; ground warps passing through the second-level twisting heald 102 form warps at a front end of the first-level twisting heald 101, the warps are divided into m sets, at least one warp passes through a twisting heald hole of each set of twisting healds as a twisting warp, at least one warp passes through an internal space of each set of twisting healds as a ground warp, each set of twisting warps no longer pass through other twisting healds of the first-level twisting heald 101, each set of ground warps no longer pass through other twisting healds of the first-level twisting heald 101, and the above internal space is in an inverted-A shape.

Further, without being limited to two levels of twisting healds, each nested twisting heald set 100 further includes a sublevel twisting heald of the first-level twisting heald arranged at a rear end of the first-level twisting heald 101 along the warp advancing direction. The sublevel twisting heald of the first twisting heald is composed of x twisting healds, where x is an integer greater than 1. The sublevel twisting heald of the first twisting heald is configured to form a leno weave containing x twisted sets through a plurality of ground warps from at least one twisting heald of the m twisting healds of the first-level twisting heald 101.

Of course, along the warp advancing direction, other levels of twisting healds may also be arranged at a rear end of the sublevel twisting heald to meet the weaving requirements of different fabric weaves.

In the present disclosure, since the first-level twisting heald and second-level twisting heald are arranged in the loom, and the number of the twisting healds of the first-level twisting heald is variable, different types of fabric weaves can be woven. Compared with the related art which can only weave the same type of fabric weaves, the applicable range is wider, thus meeting different needs of fabric weaving.

In the present disclosure, through the multi-nesting principle, the first-level twisting heald is arranged at the rear end of the second-level twisting heald, different levels of twisting healds can be arranged at the rear end of the first-level twisting heald to achieve multi-nesting, thus providing a larger design space for pattern design, forming different product gradients and meeting the needs of different customers.

The loom may adopt a jacquard device to control each heald and rapier loom weft insertion. The warps passing through the first-level twisting heald, the second-level twisting heald and the next-level twisting heald form a leno weave under the cooperation of wefts.

Moreover, a jacquard heald is further arranged at a rear end of the nested twisting heald sets 100 along the warp advancing direction. The warp passing through the nested twisting heald sets 100 passes through the jacquard heald as a ground warp only. Of course, the jacquard heald may also be replaced with a twisting heald. When the twisting heald is used, the twisting heald only uses its jacquard function. Therefore, substantively it is the same or equivalent to the function of the jacquard heald, which also falls within the scope of protection of the jacquard heald.

The jacquard heald weaves to form a jacquard weave of a vamp. The nested twisting heald sets 100 weave to form a leno weave with breathable holes of the vamp. The vamp forms a configuration of an upper.

Correspondingly, the fabric weave woven by the loom includes not only the leno weave, but also the jacquard weave.

When the arrangement space allows, the m twisting healds of the first-level twisting heald are arranged abreast along the weft direction. Since the twisting healds themselves have a certain volume, when it is required to reduce the influence of the volume of the twisting healds, the m+1 twisting healds of the nested twisting heald sets 100 are arranged in a staggered manner. More specifically, the front and rear twisting healds are not located on the same straight line, but have a position relationship of staggered arrangement along the diagonal direction. Based on the position relationship, the m twisting healds of the first-level twisting heald 101 can be simultaneously weave the warps at the front end of the first-level twisting heald 101. A next twisting heald of the nested twisting heald sets 100 deviates a previous twisting heald along the weft direction, which causes the twisting warp of the previous twisting heald passes from a position outside one side of the next twisting heald. The internal space and the twisting heald hole of the previous twisting heald are used for sorting out the ground warp and the twisting warp of the current twisting heald. The position outside the other side of the previous twisting heald is used for passing other warps for the sorting by the next twisting heald.

In order to facilitate the understanding of a multi-nested twisting method, description will be made by adding specific parameters to examples.

EXAMPLES

Referring to FIG. 1 and FIG. 2, the value of m in the several nested twisting heald sets 100 is the same and 2. The number of warps is 11, which are sequentially numbered as 1-11. Implementation steps of S1 to S4 correspond to FIG. 3 to FIG. 8, and are performed sequentially according to the serial number of figures. For the action of the twisting heald, a reference may be made to the related art CN 209555463 U.

S1: a $1^{st}$ twisting warp 1 is formed by passing a first warp of 11 warps in a batch through a twisting heald hole of a twisting heald of the second-level twisting heald 102; the first twisting warp 1 no longer passes through other twisting healds of a current nested twisting heald set 100; a first set of ground warps are formed by passing other warps through an internal space of the twisting heald of the second-level twisting heald 102;

S2: a new set of warps are formed at a front end of the first-level twisting heald 101 through the first set of ground warps; the number of the new set of warps is 10; the 10 warps are divided into two sets; one set of warps enter the internal space of the first twisting heald of the first-level twisting heald 101; a second twisting warp 2 is formed by passing a $2^{nd}$ warp through a twisting heald hole of the first twisting heald of the first-level twisting heald 101; the other set of warps enter the internal space of the second twisting heald of the first-level twisting heald 101; a third twisting warp 3 is formed by passing a seventh warp through the twisting heald hole of the second twisting heald of the first-level twisting heald 101; the first twisting warp 1, the second twisting warp 2 and the third twisting warp 3 no longer pass through other twisting healds of the current nested twisting heald set 100; the ground warp belong to the same set as the first twisting warp 1, the second twisting warp 2 and the third twisting warp 3 no longer passes through other twisting healds of the current nested twisting heald set 100;

S3: warps arranged along the same direction as in S1 are formed by passing any twisting warp and ground warp in S1 and S2 through the second-level twisting heald 102 and the first-level twisting heald 101; and S4: wefts are woven with warps according to requirements of a fabric weave.

In FIG. 1 and FIG. 2, the 10 warps are equally distributed, including 5 warps for the first twisting heald and 5 warps for the second twisting heald. During actual operation, 2 warps are left in a twisting warp. One warp is used for forming the twisting warp, and the other warp is used as the ground warp. The distribution method may also be 2 warps for the first twisting heald and 8 warps for the second twisting heald, or 3 warps for the first twisting heald and 7 warps for the second twisting heald, etc.

In step S1, since the first twisting warp 1 passes from the left side or right side outside the other twisting healds of the current nested twisting heald set 100, a configuration that the first twisting warp 1 is located on the outermost or innermost side of the secondary twisted areas 300 can be formed, layer-by-layer dense weaving can be achieved in the secondary twisted areas 300, the strength of the first twisting warp 1 is greatly improved, and it facilitates maintaining the configuration of the secondary twisted areas 300 under the external action.

In step S2, the second twisting warp 2 and the third twisting warp 3 pass from a left side or right side outside other twisting healds of the current nested twisting heald set 100. The warps located between the first-level twisting healds 101 are not adjacent. After each secondary twisted area 300 is finished, it facilitates separation to respectively form primary twisted areas 200.

Fabric weaves formed correspondingly are as shown in FIG. 9 to FIG. 13.

Compared with the related art, in the present disclosure, since the leno weave is composed of different levels of twisted areas, the pattern complexity of the leno weave is increased. Moreover, since breathable holes with different sizes are formed between different levels of twisted areas, the breathable holes with different sizes can be more fit with each part of the human body.

Compared with the related art, in the present disclosure, since a plurality of levels of twisting healds are arranged in the current nested twisting heald set and a plurality of twisting healds are arranged in each level of twisting healds, a plurality of levels of twisted areas with large area can be formed. Since numerous warps and wefts are woven complicatedly in the plurality of levels of twisted areas, the strength is better and the compression performance is better. Correspondingly, the breathable holes between the plurality of levels of twisted areas become larger, thus greatly improving the breathability of the leno weave.

The present disclosure further includes more examples.

The value of m in the nested twisting heald sets 100 may be nay value. Therefore, when the number of the warps meets the requirement, secondary twisted areas 300 with different area will be formed. The secondary twisted areas 300 with different area may be combined with each other, or may be combined with the primary twisted areas 200 with different areas to form more multi-twisted areas 400.

As described above, the multi-nested twisting loom according to the example of the present disclosure includes nested twisting heald sets 100 configured to weave a leno weave and a jacquard heald configured to weave a jacquard fabric. By using the multi-nested twisting loom, fabrics combining the leno weaves and the jacquard weaves shown in FIG. 9 to FIG. 13 can be woven in one step.

FIG. 9 to FIG. 13 are exemplary diagrams of fabric weave structures woven by the multi-nested twisting loom according to the example of the present disclosure. FIG. 9 to FIG. 13 are only limited fabric weaves described exemplarily, instead of all fabric weaves woven by the multi-nested twisting loom.

The fabric weave includes a leno weave. The leno weave includes primary twisted areas 200 and secondary twisted areas 300 formed by weaving the same batch of warps along a warp direction in one step. All ground warps twisted by twisting warps of the secondary twisted areas 300 are divided into m sets. Each primary twisted area 200 is formed by using at least one of the ground warps of each set as a twisting warp and using at least one as a ground warp to form corresponding m independent primary twisted areas 200.

The leno weave includes breathable holes. The breathable holes include large holes and small holes. Relatively the large holes are formed between adjacent secondary twisted areas 300, and the small holes are formed between adjacent primary twisted areas 200.

Figure 10:
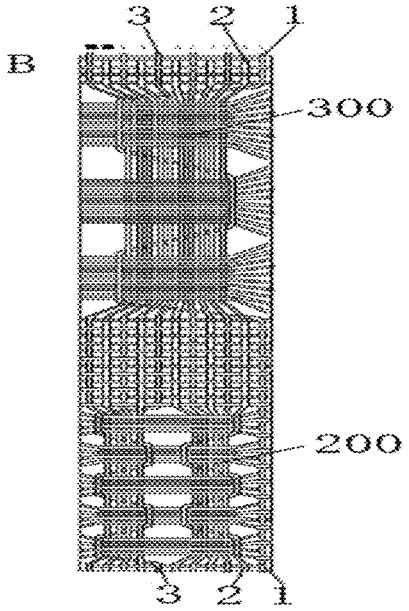
FIG. 10 illustrates a partial enlarged diagram of position B according to the present disclosure.

The twisting warps of the secondary twisted areas 300 in the range of the warp direction of the same batch of warps do not participate in the twisting of the primary twisted areas 200. Independent primary twisted areas 200 and secondary twisted areas 300 are formed, as shown in FIG. 10.

Figure 11:
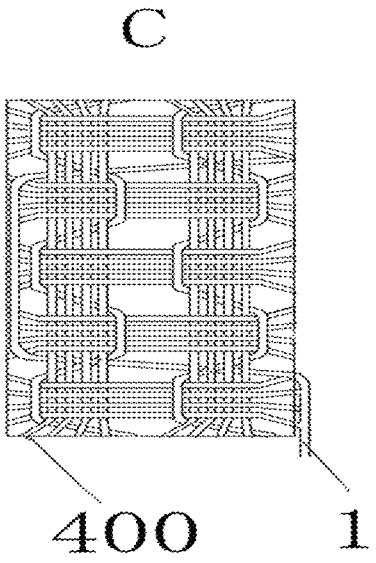
FIG. 11 illustrates a partial enlarged diagram of position C according to the present disclosure.

At least one twisting warp of the secondary twisted areas 300 in the range of the warp direction of the same batch of warps participates in the twisting of the primary twisted areas 200. Multi-twisted areas 400 are formed, as shown in FIG. 11.

Correspondingly, the above fabric weave includes any one or any combination of three elementary weaves and derivative weaves thereof. The three elementary weaves are simple weaves of fabric weaves, and are a basis of various weaves. The three elementary weaves include a plain weave, a twill weave, and a satin weave.

Any one or any combination of three elementary weaves and derivative weaves thereof is formed between the primary twisted areas 200 and the secondary twisted areas 300 along the warp direction.

In the present disclosure, the fabric weave forms a vamp. The leno weave forms a breathable part of the vamp. Any one or any combination of three elementary weaves and derivative weaves thereof maintains a configuration of the vamp.

Therefore, the fabric formed through multi-nested twisting, with the help of the leno weave structure, has excellent breathability and can maintain its configuration stably. With the help of the jacquard weave structure, various patterns can be woven, making it very useful for upper manufacturing.

An upper includes a first fabric forming a vamp configured to maintain a configuration; and a second fabric with a different weave structure from the first fabric. The first fabric is in any one or any combination of three elementary weaves and derivative weaves thereof, and the second fabric is in a leno weave.

A fabric weave includes a leno weave. The leno weave includes primary twisted areas 200 and secondary twisted areas 300 formed by weaving the same batch of warps in one step.

All ground warps twisted by twisting warps of the secondary twisted areas 300 are divided into m sets. Each primary twisted area 200 is formed by using at least one of the ground warps of each set as a twisting warp and using at least one as a ground warp to form corresponding m independent primary twisted areas 200.

Figure 12:
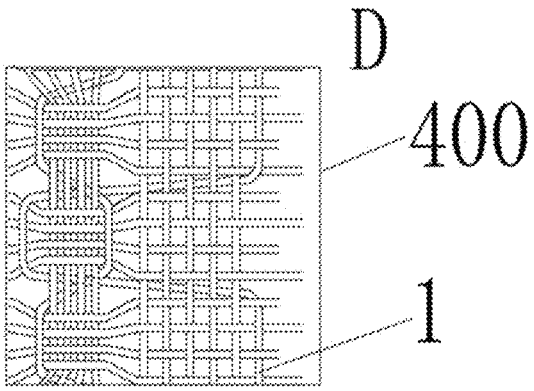
FIG. 12 illustrates a partial enlarged diagram of position D according to the present disclosure.

The twisting warps of the secondary twisted areas 300 participate in the twisting of at least one of the primary twisted areas 200 to form a multi-twisted area 400. Referring to FIG. 12, the secondary twisted areas 300 in FIG. 12 are not located directly above the primary twisted areas 200, and no breathable holes are formed in the secondary twisted areas 300.

Correspondingly, the above fabric weave includes any one or any combination of three elementary weaves and derivative weaves thereof. The three elementary weaves are simple weaves of fabric weaves, and are a basis of various weaves. The three elementary weaves include a plain weave, a twill weave, and a satin weave.

Any one or any combination of three elementary weaves and derivative weaves thereof is formed between the primary twisted areas 200 and the secondary twisted areas 300 along the warp direction.

In the present disclosure, the fabric weave forms a vamp. The leno weave forms a breathable part of the vamp. Any one or any combination of three elementary weaves and derivative weaves thereof maintains a configuration of the vamp.

Therefore, the fabric formed through multi-nested twisting, with the help of the leno weave structure, has excellent breathability and can maintain its configuration stably. With the help of the jacquard weave structure, various patterns can be woven, making it very useful for upper manufacturing.

An upper includes a first fabric forming a vamp configured to maintain a configuration; and a second fabric with a different weave structure from the first fabric. The first fabric is in any one or any combination of three elementary weaves and derivative weaves thereof, and the second fabric is in a leno weave.

Figure 13:
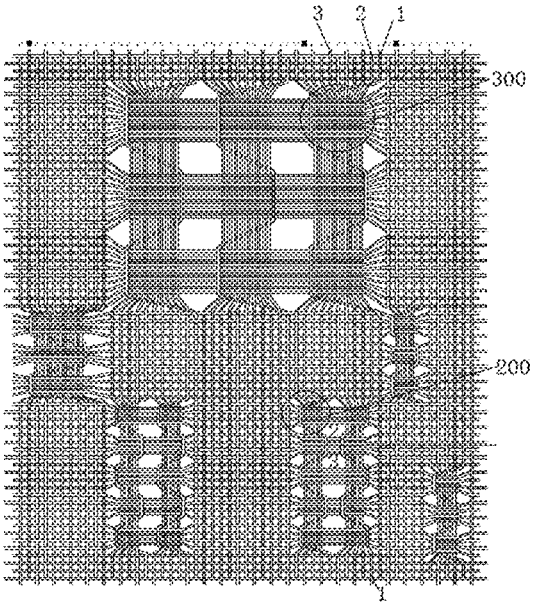
FIG. 13 illustrates another schematic structural diagram of a fabric weave according to the present disclosure.

Referring to FIG. 13, a fabric weave includes a leno weave.

The leno weave includes primary twisted areas 200 and secondary twisted areas 300 formed by weaving the same batch of warps in one step along a warp direction.

Twisting warps in the secondary twisted areas 300 do not participate in the twisting of the primary twisted areas 200. All ground warps twisted by the twisting warps of the secondary twisted areas 300 are divided into m sets. Each primary twisted area 200 is formed by using at least one of the ground warps of each set as a twisting warp and using at least one as a ground warp to form corresponding m independent primary twisted areas 200.

The leno weave includes breathable holes. The breathable holes include large holes and small holes. Relatively the large holes are formed between adjacent secondary twisted areas, and the small holes are formed between adjacent primary twisted areas 200.

Correspondingly, the above fabric weave includes any one or any combination of three elementary weaves and derivative weaves thereof. The three elementary weaves are simple weaves of fabric weaves, and are a basis of various weaves. The three elementary weaves include a plain weave, a twill weave, and a satin weave.

Any one or any combination of three elementary weaves and derivative weaves thereof is formed between the primary twisted areas 200 and the secondary twisted areas 300 along the warp direction.

In the present disclosure, the fabric weave forms a vamp. The leno weave forms a breathable part of the vamp. Any one or any combination of three elementary weaves and derivative weaves thereof maintains a configuration of the vamp.

An upper includes a first fabric forming a vamp configured to maintain a configuration; and a second fabric with a different weave structure from the first fabric. The first fabric is in any one or any combination of three elementary weaves and derivative weaves thereof, and the second fabric is in a leno weave.

Different levels of twisted areas of the above fabric weave can combined with each other to form multi-twisted areas 400. In addition, the twisting warps of the twisted areas of the previous level can participate in the twisting of the twisted areas of the next level to form multi-twisted areas 400, or do not participate in the twisting of the twisted areas of the next level to form independent primary twisted areas 200 and secondary twisted areas 300, thus enriching the patterns of fabrics such as uppers.

The above description of the disclosed examples enables those skilled in the art to implement or use the present disclosure. The various modifications to these examples will be apparent to those skilled in the art. The general principles defined herein can be implemented in other examples without departing from the spirit or scope of the present disclosure. Therefore, the present disclosure is not limited to the examples described herein, but will conform to the widest range consistent with the principles and novel features disclosed herein.

Although terms with reference numerals such as first twisting warp 1, second twisting warp 2, third twisting warp 3, nested twisting heald set 100, primary twisting heald 101, secondary twisting heald 102, primary twisted area 200, secondary twisted area 300 and multi-twisted area 400 are often used herein, the possible use of other terms is not excluded. The use of these terms is only to facilitate the description and explanation of the essence of the present disclosure, which shall not be explained as any additional limitations. Otherwise, it deviates from the spirit of the present disclosure.

What is claimed is:

1. A multi-nested twisting loom, comprising:

several nested twisting heald sets, the nested twisting heald sets being sequentially arranged along a weft direction on the loom, each nested twisting heald set comprising a second-level twisting heald at a front end of a warp advancing direction and a first-level twisting heald at a rear end, the second-level twisting heald being composed of a single twisting heald, the first-level twisting heald being composed of m twisting healds, where m is an integer greater than 1, the second-level twisting heald being configured to form a leno weave twisted by a plurality of ground warps, the first-level twisting heald being configured to form a leno weave containing m twisted sets through the plurality of ground warps from the second-level twisting heald.

2. The multi-nested twisting loom according to claim 1, wherein the multinested twisting loom comprises a jacquard heald, and the jacquard heald is arranged at a rear end of the nested twisting heald sets.

3. The multi-nested twisting loom according to claim 1, wherein the m twisting healds of the first-level twisting heald are arranged abreast along the weft direction.

4. The multi-nested twisting loom according to claim 1, wherein each nested twisting heald set comprises a sublevel twisting heald of the first-level twisting heald arranged at a rear end of the first-level twisting heald along the warp advancing direction, the sublevel twisting heald of the first twisting heald is composed of x twisting healds, where x is an integer greater than 1, and the sublevel twisting heald of the first twisting heald is configured to form a leno weave containing x twisted sets through a plurality of ground warps from at least one twisting heald of the m twisting healds of the first-level twisting heald.

5. The multi-nested twisting loom according to claim 2, wherein the jacquard heald weaves to form a jacquard weave of a vamp, the nested twisting heald sets weave to form a leno weave with breathable holes of the vamp, and the vamp forms a configuration of an upper.

6. A multi-nested twisting method, the number of twisting healds of a first-level twisting heald being m, where m is an integer greater than 1, a second-level twisting heald being composed of a single twisting heald, the multi-nested twisting method comprising the following steps:

S1: forming a twisting warp by passing at least one warp of warps through a twisting heald hole of a twisting heald of the second-level twisting heald, the twisting warp no longer passing through other twisting healds of a current nested twisting heald set; forming a first set of ground warps by passing other warps through an internal space of the twisting heald of the second-level twisting heald;

S2: forming a new set of warps at a front end of the first-level twisting heald through the first set of ground warps, dividing the new set of warps into m sets, and forming a twisting warp by passing at least one warp through a twisting heald hole of each twisting heald of the first-level twisting heald, the twisting warp no longer passing through other twisting healds of the first-level twisting heald; forming a ground warp by passing at least one warp through an internal space of each twisting heald of the first-level twisting heald, the ground warp no longer passing through internal spaces of other twisting healds of the first-level twisting heald;

S3: forming warps arranged along the same direction as in S1 by passing any twisting warp and ground warp in S1 and S2 through the second-level twisting heald and the first-level twisting heald; and S4: weaving wefts with warps according to requirements of a fabric weave.

7. The multi-nested twisting method according to claim 6, wherein the twisting warp in step S1 passes from a left side or right side outside the other twisting healds of the current nested twisting heald set.

8. The multi-nested twisting method according to claim 6, wherein the twisting warp in step S2 passes from a left side or right side outside the other twisting healds of the first-level twisting heald.

9. A multi-nested twisted fabric weave, comprising a leno weave, the leno weave comprising primary twisted areas and secondary twisted areas formed by weaving the same batch of warps along a warp direction in one step, all ground warps twisted by twisting warps of the secondary twisted areas being divided into m sets, each primary twisted area being formed by using at least one of the ground warps of each set as a twisting warp and using at least one as a ground warp to form corresponding m independent primary twisted areas;

the leno weave comprising breathable holes, the breathable holes comprising large holes and small holes, relatively the large holes being formed between adjacent secondary twisted areas, the small holes being formed between adjacent primary twisted areas.

10. The fabric weave according to claim 9, wherein the twisting warps of the secondary twisted areas in the range of the warp direction of the same batch of warps do not participate in the twisting of the primary twisted areas; or at least one twisting warp of the secondary twisted areas in the range of the warp direction of the same batch of warps participates in the twisting of the primary twisted areas.

11. The fabric weave according to claim 9, wherein the fabric weave comprises any one or any combination of three elementary weaves and derivative weaves thereof.

12. The fabric weave according to claim 9, wherein any one or any combination of three elementary weaves and derivative weaves thereof is formed between the primary twisted areas and the secondary twisted areas along the warp direction.

13. The fabric weave according to claim 9, wherein the fabric weave forms a vamp, the leno weave forms a breathable part of the vamp, and any one or any combination of three elementary weaves and derivative weaves thereof maintains a configuration of the vamp.

14. An upper woven in the multi-nested twisted fabric weave according to any one of claim 9, 10, 11, 12 or 13, comprising a first fabric forming a vamp configured to maintain a configuration; and a second fabric with a different weave structure from the first fabric, the first fabric being in any one or any combination of three elementary weaves and derivative weaves thereof, the second fabric being in a leno weave.

15. A multi-nested twisted fabric weave, comprising a leno weave, the leno weave comprising primary twisted areas and secondary twisted areas formed by weaving the same batch of warps in one step, all ground warps twisted by twisting warps of the secondary twisted areas being divided into m sets, each primary twisted area being formed by using at least one of the ground warps of each set as a twisting warp and using at least one as a ground warp to form corresponding m independent primary twisted areas;

the twisting warps of the secondary twisted areas participating in the twisting of at least one of the primary twisted areas to form a multi-twisted area.

16. The fabric weave according to claim 15, wherein the fabric weave comprises any one or any combination of three elementary weaves and derivative weaves thereof.

17. The fabric weave according to claim 15, wherein any one or any combination of three elementary weaves and derivative weaves thereof is formed between the primary twisted areas and the secondary twisted areas along the warp direction.

18. The fabric weave according to claim 15, wherein the fabric weave forms a vamp, the leno weave forms a breathable part of the vamp, and any one or any combination of three elementary weaves and derivative weaves thereof maintains a configuration of the vamp.

19. An upper woven in the multi-nested twisted fabric weave according to claim 15, comprising a first fabric forming a vamp configured to maintain a configuration; and a second fabric with a different weave structure from the first fabric, the first fabric being in any one or any combination of three elementary weaves and derivative weaves thereof, the second fabric being in a leno weave.

* * * * *